US006196666B1

(12) United States Patent
Kitamura et al.

(10) Patent No.: US 6,196,666 B1
(45) Date of Patent: Mar. 6, 2001

(54) ELECTRODE ASSEMBLY, AND METHOD FOR PRODUCING, USED IN RECORDING PROCESS

(75) Inventors: Tetsuya Kitamura, Gifu; Shigeru Kagayama, Owariasahi, both of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/090,221

(22) Filed: Jun. 4, 1998

(30) Foreign Application Priority Data

Jun. 4, 1997 (JP) ..... 9-146213

(51) Int. Cl.[7] ..... B41J 2/06
(52) U.S. Cl. ..... 347/55
(58) Field of Search ..... 347/55, 154, 103, 347/123, 111, 159, 127, 128, 17, 120, 151; 399/271, 290, 292, 293, 294, 295

(56) References Cited

U.S. PATENT DOCUMENTS 5,015,552 * 5/1991 Tamura et al. ..... 430/138
5,036,341 7/1991 Larsson .
5,504,509 4/1996 Kagayama .
5,552,814 9/1996 Maeda et al. .
5,631,679 5/1997 Kagayama .
6,026,857 * 2/2000 Obata et al. ..... 347/120

FOREIGN PATENT DOCUMENTS 6-155798 6/1994 (JP) .
7-9692 1/1995 (JP) .

* cited by examiner

*Primary Examiner*—John Barlow
*Assistant Examiner*—Raquel Yvette Gordon
(74) *Attorney, Agent, or Firm*—Oliff & Berridge, PLC

(57) ABSTRACT

An aperture electrode assembly having an insulating sheet, made of polyimide, in which a plurality of apertures having a diameter of 80 $\mu$m are formed in a line. A control electrode, made of copper leaf having a thickness of 8 $\mu$m, surrounds each of the apertures on the insulating sheet. A coating layer containing carbon particles as a conductive material is formed so as to cover both the control electrodes and the surface of the insulating sheet. As the material of the coating layer, the coating liquid is prepared by mixing the carbon particles in an insulating binder made of an organic synthetic resin, preferably, of polyimide resin. The coating liquid is applied onto the insulating sheet and the control electrodes, and baked at a temperature lower than 300° C., preferably between 200° C. and 280° C., for several minutes. A back coating layer is provided to the back surface of the insulating sheet. The back coating layer is formed by baking the coating liquid layer at a temperature of 450° C. separately from the insulating sheet and, then, the baked coating layer is adhered to the back surface of the insulating sheet using an adhesive.

25 Claims, 7 Drawing Sheets

ELECTRODE ASSEMBLY, AND METHOD FOR PRODUCING, USED IN RECORDING PROCESS

BACKGROUND OF THE INVENTION

1. Field of Invention

This invention relates to an electrode assembly, and production method, incorporated in image recording apparatuses, such as copy machines, printers, plotters, and facsimile machines, for use in the recording processes.

2. Description of Related Art

In general, an electrode assembly used in a recording process comprises a plurality of apertures, and the same number of control electrodes positioned so as to face the associated apertures. This type of electrode is called an aperture electrode. It is typically used in toner jet image recording apparatuses, in which toner particles travel in an electric field toward a recording medium to form an image on the recording medium. An example of an image recording apparatus using an aperture electrode is disclosed in Japanese Patent Application Laid-open No. 6-155798. In this publication, a predetermined voltage, based on the image data, is applied to each of the control electrodes to control the passage of toner particles (i.e., the charged particles) through the corresponding aperture. The toner particles that pass through the apertures form an image on a recording medium based on the image data.

The electrode assembly comprises an insulating film made of, for example, polyimide; control electrodes formed on the top surface of the insulating film; a top coating layer covering both the control electrodes and the insulating film; and apertures formed with the control electrodes therearound penetrating through the top coating layer and the insulating film. The top coating layer is provided for the purpose of protecting the control electrodes which are formed along the minute interconnection pattern on the insulating film. This coating layer is an insulator formed from, for example, Yupicoat (Trademark), which is a polyimide coating material manufactured by UBE Industries, Ltd., by a screen printing method through the printing, drying, and baking steps.

However, because the top coating layer is an insulating layer, this layer becomes charged during the operation of the conventional image recording apparatus having recording electrodes, which adversely affects the toner particles that pass through the apertures and fly to the recording medium.

For example, if the polyimide of the top coating layer is negatively charged, an electrostatic field repulsing the negatively charged toner particles is formed over the entire surface of the aperture electrode assembly. The leakage electric field is also formed in the apertures, which prevents the toner particles from passing through the apertures.

If the polyimide is positively charged, an electrostatic field that attracts the negatively charged toner particles is formed over the entire surface of the aperture electrode assembly, and its leakage field is formed in the apertures. This causes the negatively charged toner particles to attach to and accumulate in the apertures, which results in choked apertures.

SUMMARY OF THE INVENTION

Therefore, it is an object of the invention to overcome these problems in the prior art, and to provide an electrode assembly, used in the recording process and apparatuses, which allows for high-quality image formation over a long span of time.

In order to achieve the object, in one aspect of the invention, a recording electrode assembly that controls ejection of charged particles toward a recording medium is provided. The recording electrode assembly is positioned between a charged particle supply unit for supplying the charged particles and a rear electrode device that attracts the charged particles. The recording electrode has an insulating sheet, and a plurality of passages formed in the insulating sheet, through which the charged particles are ejected. Control electrodes are also provided on the insulating sheet in order to control the charged particles passing through the passages. The control electrodes are covered with a coating layer which is made of a material containing an anti-electrification agent.

The coating layer may be baked so as to be hardened.

The coating layer is made of a mixture of an insulating material and a conductive material, one of which being a base material, the other being an additive. The additive is mixed or dispersed into the base material prior to forming the coating layer.

The additive is, for example, a conductive material having a diameter of 1 $\mu$m or smaller. Alternatively, the additive may be conductive carbon particles, such as artificial graphite. Preferably, the conductive material as the additive has a diameter equal to or smaller than one tenth of the charged particle.

The insulating material is, for example, polyimide resin.

The conductive material can also be one selected from a group including aluminum, molybdenum, nickel, and chromium.

If carbon is used as the conductive material, and if polyimide is used as the insulator, it is preferable to disperse the carbon to be equal to or more than 0.05 weight parts and less than 0.10 weight part into 1 weight part of solid polyimide resin.

More preferably, 0.07 weight parts of carbon is dispersed into 1 weight part of solid polyimide resin.

The recording electrode assembly may further comprise a back coating layer that is formed so as to face the charged particle supply unit. The back coating layer may be adhered to the back surface of the insulating sheet by an adhesive which contains an anti-electrification agent. Preferably, the back coating layer contains an anti-electrification agent, a lubricant, and an electric charge adjusting agent. The anti-electrification agent is one selected from a group including carbon, polypyrrole, polyacetylene, and polythiophene. The lubricant is one selected from a group including silica, alumina, silicon fine-grain, titanium oxide, and zinc oxide. The electric charge adjusting agent is one selected from a group including quaternary ammonium salt (+), azo dye (−), and azine compound (+).

The coating layer is formed by the steps of dispersing the conductive material in the binder, applying the binder in which the conductive material is dispersed onto the insulating sheet and the control electrodes so as to cover both the insulating sheet and the control electrodes, and baking the binder in order to harden the coating layer.

When forming the back coating layer, an anti-electrification agent, a lubricant, and an electric charge adjusting agent are added into a binder and stirred with the binder. The binder containing the anti-electrification agent, the lubricant, and the electric charge adjusting agent is applied onto a board. Then, the binder and the board are baked. After baking, the binder is removed from the board. Finally, the binder is attached, as the back coating layer, onto the back surface of the insulating sheet.

The recording electrode assembly according to the invention can prevent electrification of the coating layer and, therefore, the passage of the charged particles through apertures can be accurately controlled by application of the voltage to the control electrodes. Because the recording electrode assembly of the invention can prevent the charged particles from accumulating in the passages, a stable and high-quality image recording operation can be maintained over a long span of time.

The coating layer is made of a mixture of an insulator and a conductive material, which is stable in structure.

Since the diameter of the conductive material contained in the coating layer is 1 $\mu$m or less, even if the particles of the conductive material come to the surface of the coating layer, they do not prevent ejection of the charged (toner) particles. For the same reason, the diameter of the conductive particles of the coating layer may be set equal to or smaller than one tenth of the diameter of the charged toner particle. This allows a highly precise recording operation without affecting ejection of the charged particles.

Using conductive carbon particles as the conductive material allows the anti-electrification material to be manufactured at a low cost. Artificial graphite is preferably used as the material of conductive particles because carbon particles having a diameter of 1 $\mu$m or smaller can be easily manufactured from the artificial graphite.

The diameter of the conductive particles of the coating layer is set equal to or smaller than one tenth of that of the charged toner particles. In this size range, even if the carbon particles come to the surface of the coating layer, they do not disturb the ejection or flow of the toner particles, whereby a precise recording operation can be maintained.

In order to avoid distortion of the insulating sheet, the back coating layer is baked separately from the insulating sheet because the baking process is generally performed at a high temperature of about 450° C. By baking the back coating layer, a rigid back layer is achieved. The baked back coating layer is adhered onto the back surface of the insulating sheet.

BRIEF DESCRIPTION OF THE DRAWINGS

A preferred embodiment of the invention will be described in detail with reference to the attached drawings wherein.

DETAILED DESCRIPTION OF PREFERRED EMBODIMENTS

The preferred embodiments of the invention will now be described with reference to the attached drawings.

Figure 1:
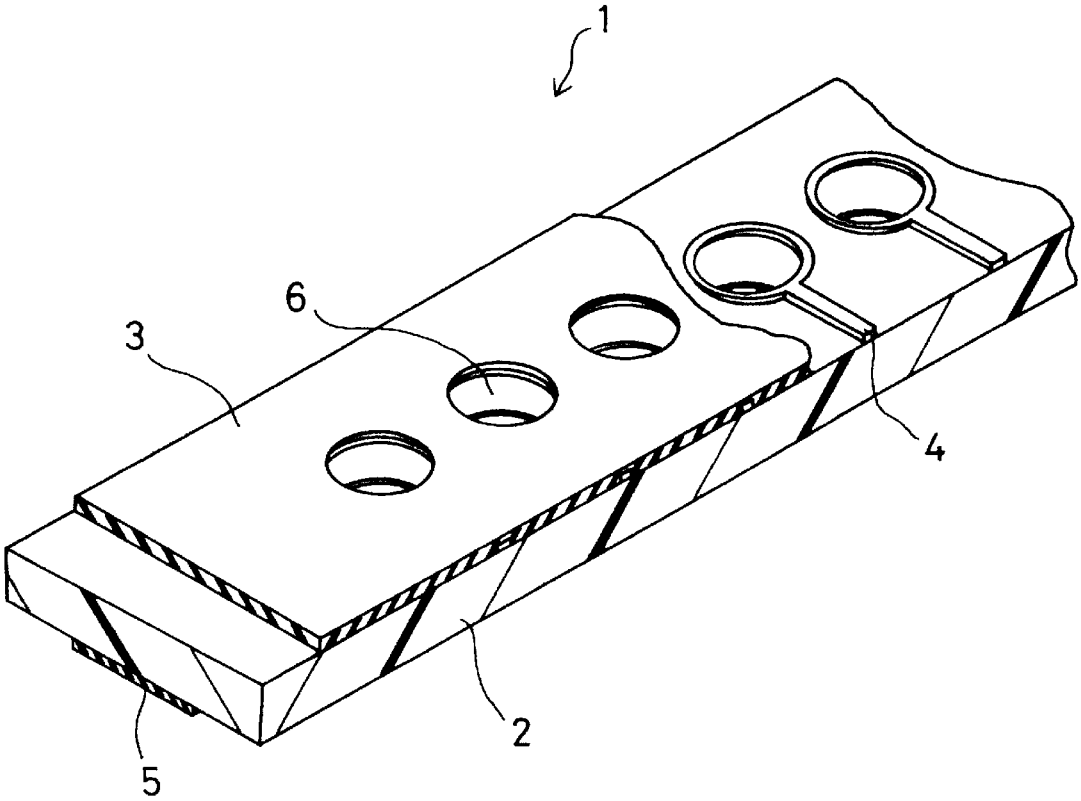
FIG. 1 is an enlarged perspective view of a part of the recording electrode assembly according to the first embodiment of the invention.

FIG. 1 illustrates an aperture electrode assembly (i.e., a recording electrode assembly) 1 according to the first embodiment of the invention.

As shown in FIG. 1, a plurality of apertures 6 having a diameter of 80 $\mu$m are formed in a line in a polyimide insulating sheet 2 having a thickness of 25 $\mu$m. The apertures 6 serve as passages through which charged toner particles are ejected. A control electrode 4 made of copper leaf and having a thickness of 8 $\mu$m extends from each of the apertures 6. A top coating layer 3 is formed over the control electrodes 4 and the insulating sheet 2 so that the thickness of the top coating layer 3 from the insulating sheet 2 is 10 $\mu$m. Accordingly, the thickness of the top coating layer 3 over the control electrode is 2 $\mu$m because the thickness of the control electrode itself is 8 $\mu$m.

Figure 2:
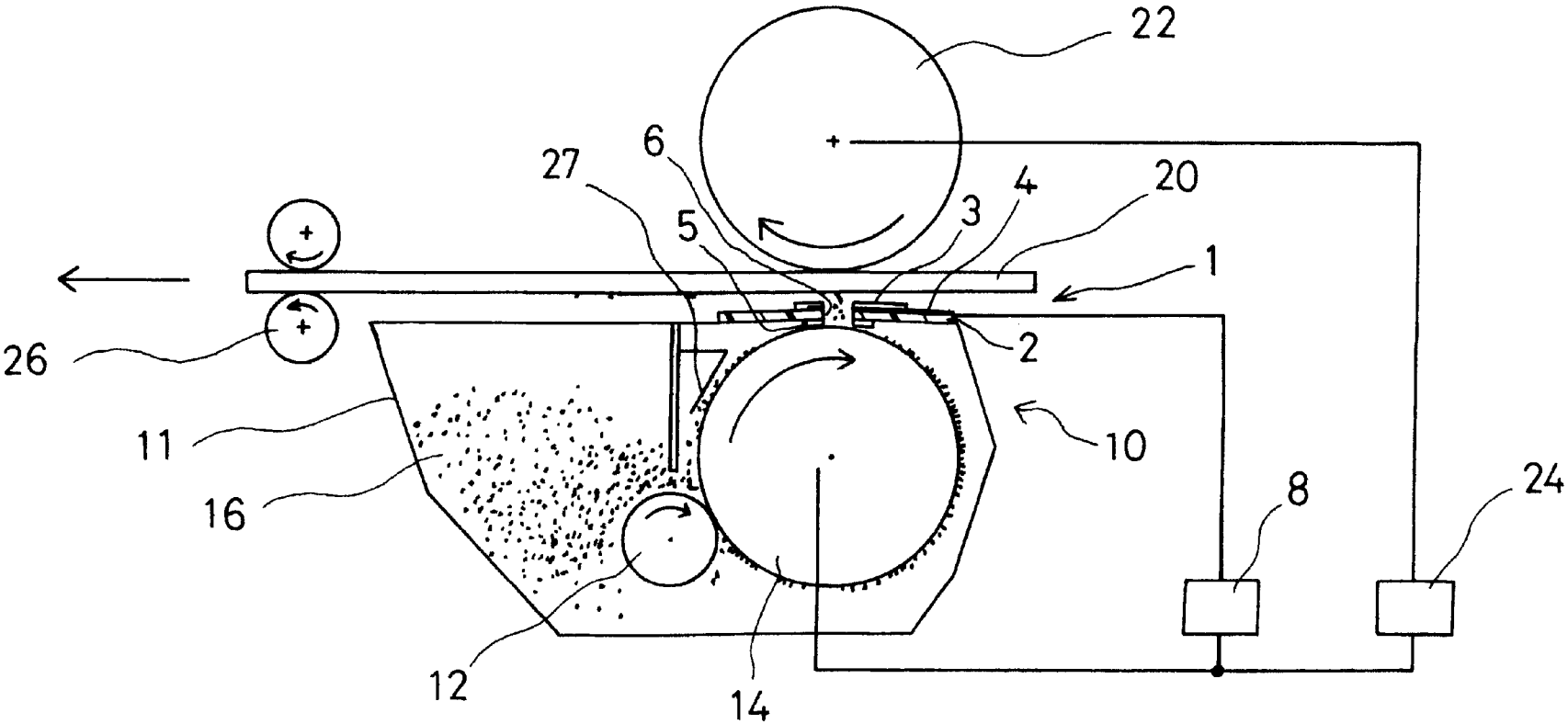
FIG. 2 is a cross-sectional view of the image recording apparatus in which the recording electrode assemble of the first embodiment is installed.

A back coating layer 5 having a thickness of 3 $\mu$m is provided on the rear surface of the insulating sheet 2. When the aperture electrode assembly 1 is installed in an image recording apparatus, as shown in FIG. 2, the back coating layer 5 comes into contact with a toner carrying roller 14 via toner particles (i.e., charged particles) 16. As the roller 14 rotates, the roller surface and the back coating layer 5 rub against each other with the charged particles 16 between them. In order to prevent any undesirable charges, the back coating layer 5 has an anti-electrification, or anti-charging effect.

Figure 3:
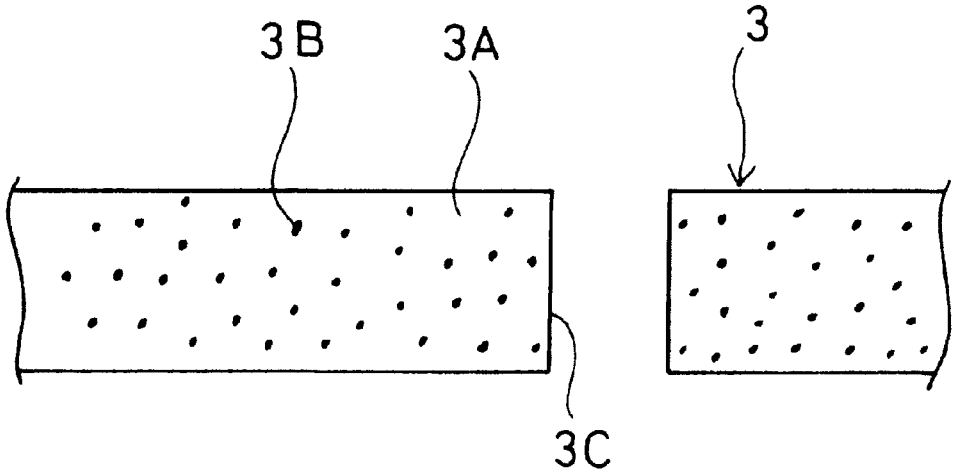
FIG. 3 illustrates the top coating layer in a vertical cross-sectional view.

FIG. 3 shows a top coating layer 3 in a cross-sectional view. Carbon particles 3B, as a conductive material, are dispersed in the binder 3A which is an insulator consisting of an organic synthetic resin. In this embodiment, polyimide is used as the insulating material. The carbon particles 3B are mixed into the polyimide resin to prepare a coating material before the coating layer 3 is formed on the insulating sheet 2. The coating material is applied on the insulating sheet 2 so as to cover both the control electrodes 4 and the top surface of the insulating sheet 2. Then, the coating layer 3 is baked for a several minutes at a temperature lower than 300° C. Preferably, the baking temperature is in the range of 200° C. to 280° C. Although, in the embodiment, carbon particles are used as the conducting material because they are less expensive, aluminum, molybdenum, nickel, and chromium particles can also be used as the conducting material.

The binder 3A is Yupicoat (trademark), a polyimide resin whose solid ratio is 50%, manufactured by UBE Industries, Ltd. It was found through experiments that if conductive carbon black "3050B", manufactured by Mitsubishi Chemical, Ltd., of 0.33 weight parts is mixed in 10 weight parts Yupicoat (i.e., the binder), an excellent anti-electrification coating layer can be obtained. Focusing only on the solid component, it is optimal to mix carbon of 0.066 weight parts into polyimide of 1 weight part. This is because if the conductivity exceeds $10^{-6}$, the electric resistance becomes insufficient, which adversely affects the control electrodes 4. On the other hand, if the conductivity is too low, the anti-electrification effect decreases. To this end, carbon particles equal to or more than 0.05 weight parts and less than 0.10 weight parts are preferably dispersed into 1 weight part of binder (i.e., solid polyimide resin) so that the resultant layer has an appropriate conductivity and effectively serves as the anti-electrification coating layer. In the range described above, the most preferable result is obtained if carbon particles of about 0.07 weight parts, and more specifically, of 0.066 weight parts is mixed in polyimide resin of 1 weight part.

When dispersing the carbon particles, a media dispersion method is used, in which the coating liquid is stirred at a revolution rate of about 800 rpm using ceramic beads having a diameter of about 1 mm as dispersion media. After the stirring, the coating liquid is filtered in order to remove the ceramic beads.

The diameter of the primary particles of conductive carbon black "3050B" (Mitsubishi Chemical Ltd.) is about 40 nm before the cohesion. By using a media dispersion method, the carbon particles can be dispersed throughout the polyimide resin in a separated state such that the carbon particles do not adhere to one another. The carbon black "3050B" is an artificial graphite obtained by burning fats and oils. Accordingly, fine carbon black particles having a diameter of several tens nanometer can be easily obtained, unlike pulverizing natural graphite.

Returning to FIG. 2, the aperture electrode assembly 1 according to the first embodiment is installed in an image recording apparatus.

A cylindrical rear electrode roller 22 is supported by a chassis (not shown) in rotatable manner directly above the aperture electrode 1 with a gap of 1 $\mu$mm between them. The rear electrode roller 22 is rotated in the clockwise direction in the figure by a feed motor (not shown).

A recording medium (e.g., a paper or an OHP sheet) is fed by the rear electrode roller 22 through the gap to the left in the figure, while it keeps a predetermined distance from the aperture electrode 1.

A toner supply unit 10 is positioned below the aperture electrode 1 along the longitudinal axis (or the line of apertures) of the aperture electrode 1. A fixing device 26 is placed downstream of the electrode roller 22. The fixing device 26 heats the toner particles 16 attached to the surface of the recording medium 20 in order to thermally fix the toner particles 16 onto the recording medium 20.

The toner supply unit 10 comprises a toner case 11, which also serves as a housing of the toner supply unit 10, toner particles 16 contained in the toner case 11, a supply roller 12, a toner carrying roller 14, and a toner layer control blade 27. The cylindrical toner supply roller 12 supplies the toner particles 16 to the toner carrying roller 14, which then carries charged toner particles 16 on its cylindrical surface. As the toner carrying roller 14 rotates, charged toner particles are continuously fed to the aperture electrode 1. The mean diameter of the toner particles is about 10 $\mu$m.

The toner supply roller 12 and the toner carrying roller 14 are supported so that the cylindrical surfaces of these two rollers 12, 14 contact with each other, and that they are rotatable in the direction indicated by the arrows in the figure. The rotation axes of these two rollers are parallel to each other. The toner supply roller 12 and the toner carrying roller 14 are rotated together by a driving motor (not shown) via a gear (not shown).

The toner layer control blade 27 is pressed against the toner carrying roller 14 in order to even out the toner particles 16 carried on the cylindrical surface of the toner carrying roller 14. The toner layer control blade 27 also negatively charges the toner particles 16.

As shown in FIG. 2, the top coating layer 3 of the aperture electrode 1 faces the recording medium, while the back coating layer 5, formed on the back face of the insulating sheet 2, rubs against the toner carrying roller 14 and the toner particles carried on the roller surface at and around the apertures. The insulating sheet 2 is flexible so that it can bend along the outer surface of the toner carrying roller 14 when the toner carrying roller is pressed against the back face of the insulating sheet 2. Such insulating sheets are described in U.S. Pat. Nos. 5,504,509, 5,631,679, and 5,552,814, the disclosures of which are incorporated by reference herein.

A control voltage application circuit 8 is connected between the control electrode 4 and the toner carrying roller 14. The control voltage application circuit 8 receives image signals representing the dot pattern of the original from an external source, and controls the ON/OFF operation (that is, voltage application of +20V/−20V) of each of the control electrodes 4 based on the ON/OFF pattern of the dot series. The voltage control operation is performed in association with the rotation of the rear electrode roller 22. When ejection of toner particles for one dot line has been completed with help of the rear electrode roller 22, then the ON/OFF state of the control electrodes 4 are newly controlled for the next dot line.

A direct current power source 24 is connected between the rear electrode roller 22 and the toner carrying roller 14. The direct current power source 24 can apply a voltage of +1 kV to the rear electrode roller 22.

In operation, when the toner supply roller 12 and the toner carrying roller 14 are rotated in the direction indicated by the arrows in FIG. 2, the toner particles 16 fed by the toner supply roller 12 are rubbed onto the cylindrical surface of the toner carrying roller 14 through the frictional contact between the toner supply roller 12 and the toner carrying roller 14.

Figure 4:
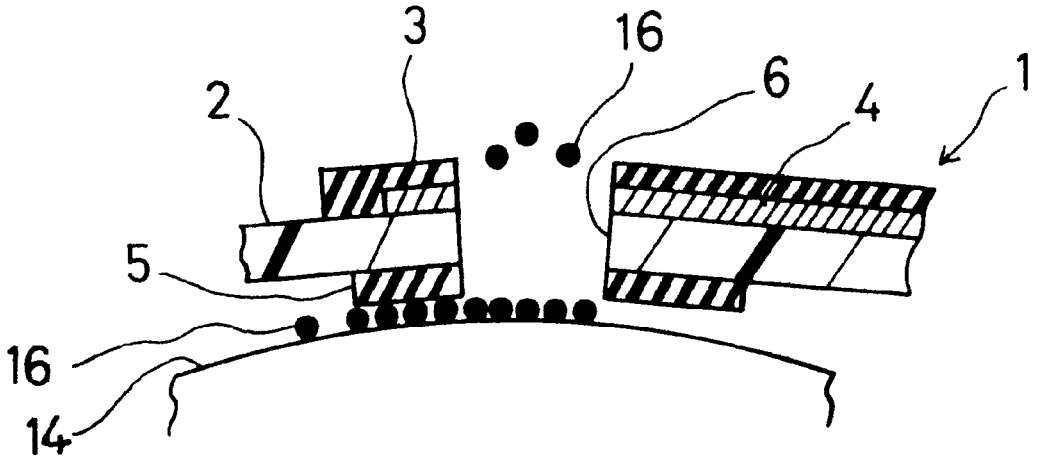
FIG. 4 illustrates the positional relation between the recording electrode assembly of the first embodiment and the toner carrying roller.

The toner particles 16 accumulated on the cylindrical surface of the toner carrying roller 14 are leveled off and negatively charged by the toner layer control blade 27, and fed toward the aperture electrode 1 as the toner carrying roller 14 rotates. The charged toner particles 16 are rubbed against the back coating layer 5 of the aperture electrode 1, and brought directly under the aperture 6, as shown in FIG. 4. The frictional contact between the toner carrying roller 14 and the back coating layer 5 makes the charged toner particles 16 easily separate from the toner carrying roller 14 surface when they come under the aperture 6. Thus, the toner flow can be controlled at a low voltage. In other words, because the toner particles 16 roll on the cylindrical surface of the toner carrying roller 14 as the toner carrying roller 14 rotates and frictionally contact with the aperture electrode 1, they can leave the toner carrying roller 14 surface more easily than in the stationary state. Accordingly, the control electrodes 4 require only a low voltage to be applied in order to attract the charged toner particles 16 from the surface of the toner carrying roller 14.

When, based on the image data, a voltage of +20V is applied from the control voltage application circuit 8 to the control electrodes 4 that correspond to the ON dots in the currently processed dot line, electric force lines are formed from the control electrodes 4 toward the toner carrying roller 14 near the apertures corresponding to the ON dots due to the potential difference between the control electrodes 4 and the toner carrying roller 14. As a result, the negatively charged toner particles receive an electrostatic force from a higher potential, and they separate from the toner carrying roller 14, pass through the aperture 6, and reach the control electrode 4 side of the aperture electrode assembly 1. The toner particles are further attracted by the rear electrode 22, and they travel toward the recording medium 20 in the electric field formed between the aperture electrode assembly 1 and the recording medium 20 due to the voltage applied to the rear electrode 22. The toner particles accumulate on the recording medium 20, and form dot pixels on it.

On the other hand, a voltage of −20V is applied from the control voltage application circuit 8 to the control electrodes 4 that correspond to the non-image part (i.e., the OFF dots in the currently processed dot line). As a result, electric force lines toward the control electrodes 4 are formed between the control electrodes 4 and the toner carrying roller 14. The negatively charged toner particles stay on the toner carrying roller 14 receiving an electrostatic force of a higher potential, and they do not pass through the apertures 6.

The negatively charged toner particles 16 that have passed through the apertures 6 can fly to the rear electrode roller 22 without suffering an undesirable electric force because the top coating layer 3 of the aperture electrode assembly 1 has an anti-electrification ability.

In the conventional recording electrode assembly, the top coating layer is made of polyimide that does not contain carbon particles. Since the conventional top coating layer completely functions as an insulating layer, it becomes charged during the recording operation, which adversely affects the ejection of the toner particles. If the polyimide layer is negatively charged, an electrostatic field repulsing the negatively charged toner particles is formed over the entire surface of the aperture electrode assembly, and its leakage electric field is formed in the apertures. This prevents the toner particles from passing through the apertures. Conversely, if the polyimide layer is positively charged, an electrostatic field that attracts the negatively charged toner particles is formed over the entire surface of the aperture electrode assembly, and its leakage field is formed in the apertures. This causes the negatively charged toner particles to attach to and accumulate in the apertures, which results in choked apertures.

In order to overcome this problem, in the invention, the top coating layer 3 is designed so as to have an anti-electrification ability so that passage of the toner particles through the apertures can be precisely controlled without suffering the adverse effect of the electrification or charging. This arrangement can also prevent the toner particles from accumulating around the aperture 6, whereby a stable and high-quality recording operation can be maintained over a long span of time.

The recording medium 20 is fed in the direction perpendicular to the aperture line by one dot pixel, while a line of dot pixels are being formed by the toner particles 16 on the recording medium 20. By repeating the process described above, the toner image is formed on the surface of the recording medium 20. The toner image is then thermally fixed onto the recording medium 20 by the fixing device 26.

The invention is not limited to this specific embodiment, but many changes can be made without departing from the scope of the invention.

For example, although, in the first embodiment, the carbon particles having a diameter of 40 nm are dispersed in the polyimide, many other sizes of carbon particles can be used as long as they do not disturb the flow of the toner particles whose diameter is 10 $\mu$m. As a criterion, if the diameter of the carbon particles is equal to or smaller than one tenth of that of the toner particles, that is, if the diameter of the carbon particle is 1 $\mu$m or less, it does not affect the toner flow. Even if the carbon particles rise to the surface of the top coating layer 3 inside the aperture 3C (shown in FIG. 3), and if the toner particles collide with the surface carbon particles, the flow (or ejection) direction of the toner particles is not influenced.

In addition, the carbon particles are not limited to the conductive carbon black "3050" manufactured by Mitsubishi Chemical Ltd., which has a long carbon structure. For example, nonconductive carbon black having a short carbon structure may be used. It was found that if the nonconductive carbon black having a short carbon structure is dispersed in the polyimide layer at a higher mixture ratio than the conductive carbon black, an anti-electrification, or anti-charging, effect similar to the conductive carbon black is achieved. However, because the higher ratio of the carbon particles slightly spoils the mechanical characteristics of the top coating layer, conductive carbon black is more preferable.

Furthermore, a mesh type electrode assembly disclosed in, for example, Japan National Phase Laid Open Patent Application 1-503221 may be used in place of the aperture electrode assembly in order to control the toner flow.

Next, the second embodiment of the invention will be described with reference to FIG. 5.

Figure 5:
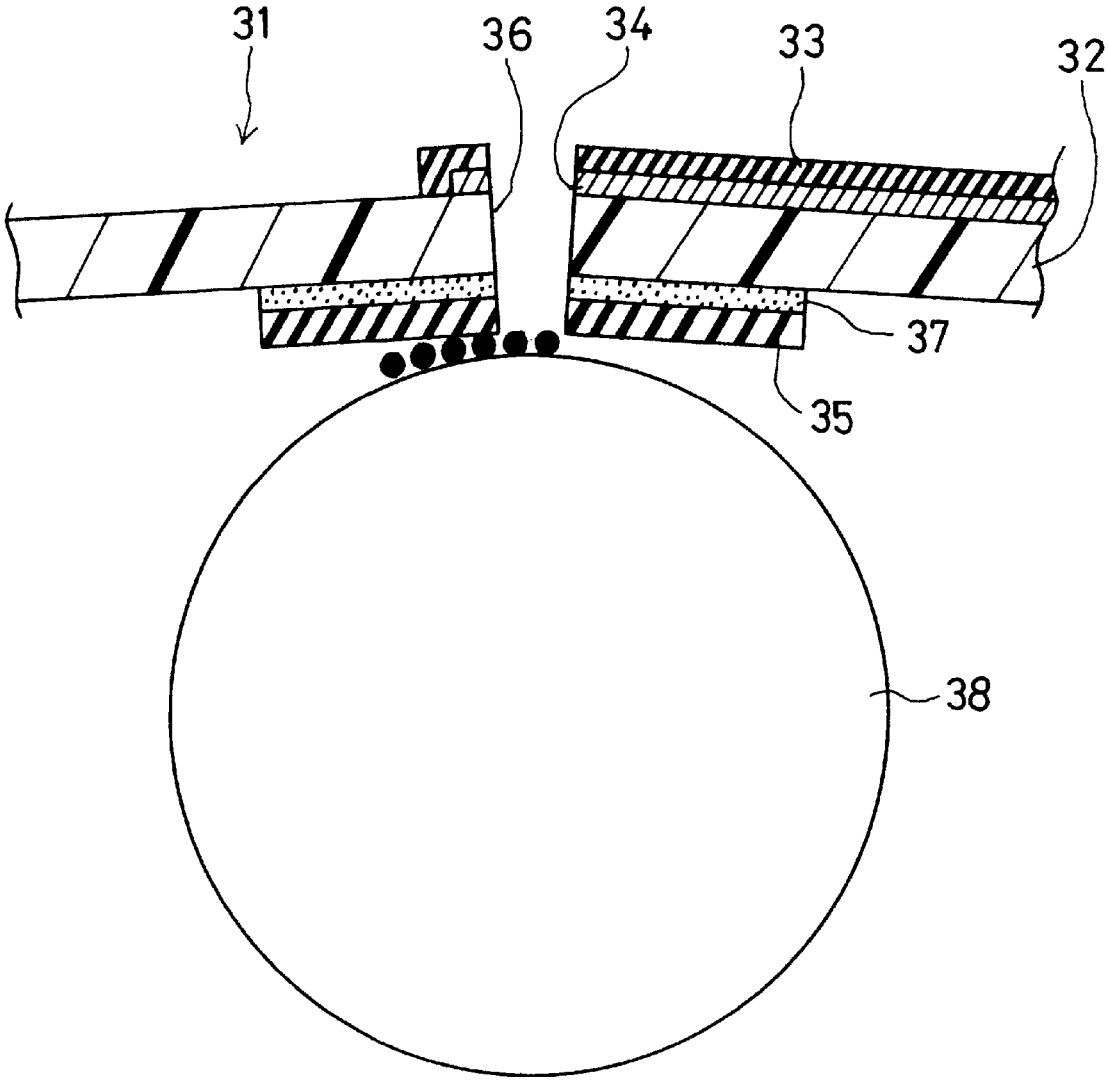
FIG. 5 illustrates the positional recording electrode assembly according to the second embodiment of the invention and the toner carrying roller.

FIG. 5 illustrates an aperture electrode assembly 31 and a toner carrying roller 38 in a cross-sectional view.

The aperture electrode assembly 31 comprises an insulating sheet 32 made of polyimide and having a thickness of 25 $\mu$m. A plurality of apertures 36 having a diameter of 80 $\mu$m are formed in the insulating sheet 32, through which charged particles are ejected toward a recording medium. Control electrodes 34, made of copper leaf and having a thickness of 8 $\mu$m, are formed on the top surface of the insulating sheet 32 so as to extend from the respective apertures 36. A top coating layer 33 is formed over the control electrodes 34 and the insulating sheet 32 so that the thickness of the top coating layer 33 from the insulating sheet 32 is 10 $\mu$m. Accordingly, the thickness of the top coating layer 33 over the control electrode 34 is 2 $\mu$m because the thickness of the control electrode itself is 8 $\mu$m.

A back coating layer 35 is provided to the other side of the insulating sheet 32. The back coating layer 35 is attached to the back surface of the insulating sheet 32 via an adhesive layer 37.

The adhesive layer 37 is made of epoxy adhesive or polyimide adhesive. The adhesive layer 37 also contains carbon black particles as an anti-electrification agent in order to prevent electrification of the adhesive layer 37.

Figure 6:
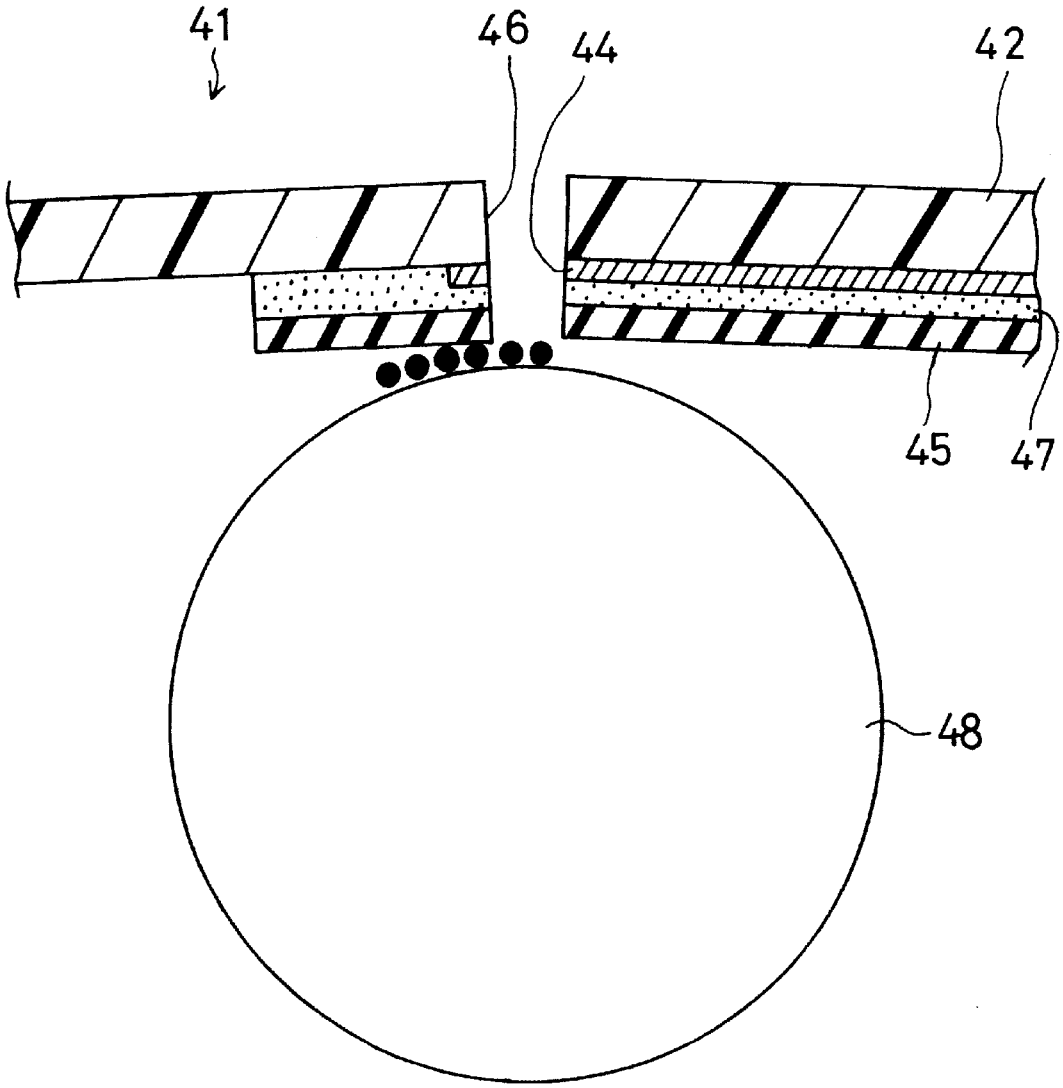
FIG. 6 illustrates the positional relationship between the recording electrode assembly according to the third embodiment of the invention and the toner carrying roller.

FIG. 6 illustrates an aperture electrode assembly 41 according to the third embodiment of the invention, together with a toner carrying roller 48, in a cross-sectional view.

In the third embodiment, the aperture electrode assembly 41 comprises an insulating sheet 42 made of polyimide and having a thickness of 50 $\mu$m. A plurality of apertures 46 having a diameter of 80 $\mu$m are formed in the insulating sheet 42, through which charged particles are ejected toward a recording medium. Control electrodes 44 made of copper leaf and having a thickness of 5 $\mu$m are formed on the bottom surface of the insulating sheet 42 in order to generate an electric field in the apertures 46. A back coating layer 45 is provided via an adhesive layer 47 so as to cover the control electrodes 44 and the bottom face of the insulating sheet 42.

The adhesive layer 47 is made of epoxy adhesive or polyimide adhesive as in the second embodiment. The adhesive layer 47 contains carbon black particles as an anti-electrification agent in order to prevent electrification of the adhesive layer 47.

The thickness of the back coating layer 45 is 15 $\mu$m, and the thickness of the adhesive layer 47 is 10 $\mu$m.

The aperture electrode assembly 41 of the third embodiment has the control electrodes 47 on the bottom face of the insulating sheet 42 so that the control electrodes 47 face the toner carrying roller 48. This type of aperture electrode is generally called a back electrode.

Next, the manufacturing method for the back coating layers 35 and 45 provided to the aperture electrode assemblies 31 and 41 of the second and third embodiments will be described with reference to FIGS. 7A–7E.

The back coating layers 35 and 45 are baked films. The manufacturing method of these films comprises four steps.

In the first step, a coating liquid is prepared, which is to be baked in a later step. A solution of polyimide resin is used as the base binder. An anti-electrification agent, a lubricant, and an electric charge adjusting agent are added into the solution, and the solution is stirred.

Examples of anti-electrification agents include carbon, polypyrrole, polyacetylene, and polythiophene. The lubricant is, for example, silica, alumina, silicon fine-grain, titanium oxide, and zinc oxide. The electric charge adjusting agent is selected from a group consisting of quaternary ammonium salt (+), azo dye (−), and azine compound (+).

Figure 7A:
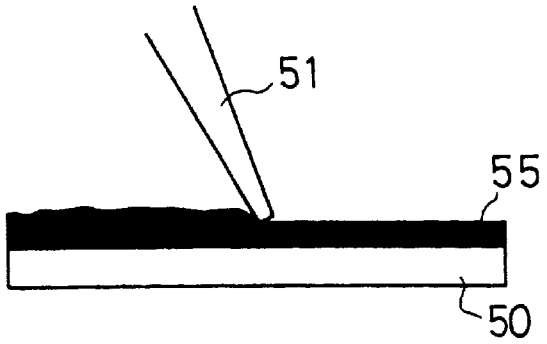
FIGS. 7A through 7E shows the manufacturing steps of the back coating layer according to the invention.
Figure 7B:
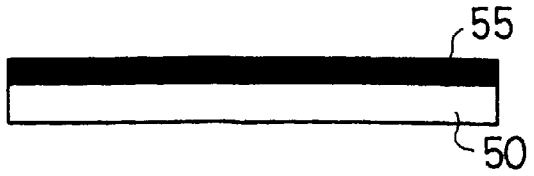

In the second step, as shown in FIG. 7A, the coating liquid is applied onto a heat-resistant board 50 using a spatula called a squeegee. The coating liquid can be applied using a roller called a bar-coater, or alternatively, the board 50 may be directly dipped in the coating liquid (a method called dipping). Thus, the even coating layer 55 is formed on the board 50, as shown in FIG. 7B.

Figure 7C:
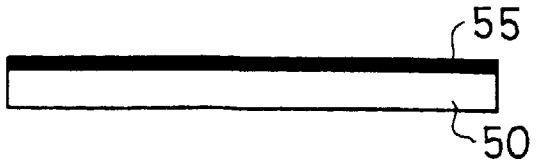

Then, in the third step, the coating layer 55 and the board 50 are baked at a temperature suitable to the setting reaction of the base binder. If polyimide is used as the base binder, the layer is baked at 450° C. for several minutes. FIG. 7C illustrates the coating layer and the board after the baking step is completed.

Figure 7D:
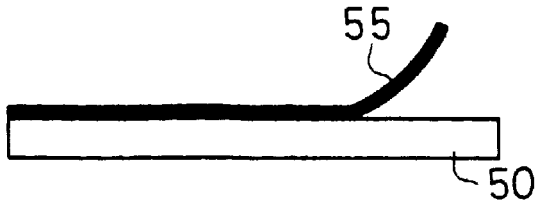
Figure 7E:
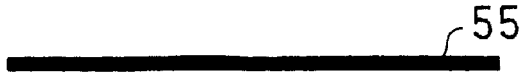

Finally, the baked coating layer 55 is removed from the board 50, as shown in FIG. 7D. FIG. 7E shows the removed coating layer 55, which is then adhered onto the aperture electrode assemblies 31, 41 as the back coating layers 35, 45.

Because the back coating layers 35,45 are baked separately from the insulating sheets 32,42 in order avoid thermal distortion or deformation of the insulating sheets 32,42, the coating layers can be baked at a high temperature of 450° C., whereby hard and rigid back coating layers 35,45 are obtained.

It should be understood that many changes and substitutions may be made by those skilled in the art without departing from the spirit and the scope of the invention.

What is claimed is:

1. A recording electrode assembly that controls ejection of charged particles, the recording electrode assembly being positioned between a charged particle supply unit for supplying the charged particles and a rear electrode device that attracts the charged particles, the recording electrode assembly comprising:

an insulating sheet;

a plurality of passages formed in the insulating sheet, through which the charged particles are ejected;

a plurality of control electrodes, a control electrode associated with each passage, that control the charged particles passing through the passages; and a coating layer that covers the control electrodes, the coating layer being made of a material containing an anti-electrification agent, wherein the anti-electrification agent is a conductive material whose diameter is equal to or smaller than one tenth of the diameter of the charged particles.

2. The recording electrode assembly according to claim 1, wherein the coating layer is baked so as to be hardened.

3. The recording electrode assembly according to claim 2, wherein the coating layer is formed by the steps of:

dispersing the conductive material in the binder;

applying the binder in which the conductive material is dispersed onto the insulating sheet and the control electrodes so as to cover both the insulating sheet and the control electrodes; and baking the binder in order to harden the coating layer.

4. The recording electrode assembly according to claim 1, wherein the coating layer is made of a mixture of an insulating material and a conductive material, one of which being a base material, the other being an additive, and wherein the additive is mixed or dispersed into the base material prior to forming the coating layer.

5. The recording electrode assembly according to claim 4, wherein the additive is a conductive material having a diameter of 1 $\mu$m or smaller.

6. The recording electrode assembly according to claim 4, wherein the additive is conductive carbon particles.

7. The recording electrode assembly according to claim 6, wherein the conductive carbon particle is artificial graphite.

8. The recording electrode assembly according to claim 4, wherein the insulating material is polyimide resin.

9. The recording electrode assembly according to claim 8, wherein carbon is used as the conductive material, and the carbon of equal to or more than 0.05 weight parts and less than 0.10 weight part is dispersed into 1 weight part of solid polyimide resin.

10. The recording electrode assembly according to claim 8, wherein 0.07 weight parts of carbon is dispersed into 1 weight part of solid polyimide resin.

11. The recording electrode assembly according to claim 4, wherein the conductive material is one selected from a group consisting of aluminum, molybdenum, nickel, and chromium.

12. The recording electrode assembly according to claim 1, wherein a back coating layer is provided facing the charged particle supply unit.

13. The recording electrode assembly according to claim 12, wherein the back coating layer is adhered to the back surface of the insulating sheet by an adhesive.

14. The recording electrode assembly according to claim 13, wherein the adhesive contains an anti-electrification agent.

15. The recording electrode assembly according to claim 13, wherein the back coating layer contains an anti-electrification agent, a lubricant, and an electric charge adjusting agent.

16. The recording electrode assembly according to claim 15, wherein the anti-electrification agent is at least one selected from a group consisting of carbon, polypyrrole, polyacetylene, and polythiophene.

17. The recording electrode assembly according to claim 15, wherein the lubricant is at least one selected from a group consisting of silica, alumina, silicon fine-grain, titanium oxide, and zinc oxide.

18. The recording electrode assembly according to claim 15, wherein the electric charge adjusting agent is at least one selected from a group consisting of quaternary ammonium salt (+), azo dye (−), and azine compound (+).

19. The recording electrode assembly according to claim 13, wherein the back coating layer is formed by the steps of:

adding an anti-electrification agent, a lubricant, and an electric charge adjusting agent into a binder and stirring the binder;

applying the binder containing the anti-electrification agent, the lubricant, and the electric charge adjusting agent onto a support surface;

baking the binder applied onto the support surface;

removing the baked binder from the support surface; and adhering the binder as the back coating layer onto the insulating sheet.

20. A method for producing an aperture electrode for passing toner particles, comprising the steps of:

forming an insulating substrate with a plurality of apertures therein;

applying a plurality of control electrodes to the insulating substrate, a control electrode associated with each aperture;

mixing a coating layer formed of at least a binder material and a conductive material; and applying the coating layer to cover a surface of the insulating substrate and the control electrodes thereon, wherein the conductive material comprises particles having a diameter equal to or smaller than one tenth of the diameter of the toner particles.

21. The method according to claim 20, further comprising the step of baking the aperture electrode at a temperature in the range of 200–280° C. for several minutes after the coating layer is applied.

22. The method according to claim 20, further comprising the steps of:

spreading the coating layer on a support surface;

baking the support surface and coating layer at a temperature of 450° C. for several minutes; and separating the coating layer and the support surface, wherein the step of applying the coating layer includes the steps of covering the surface of the insulating substrate and the control electrodes with an adhesive and adhering the coating layer to the adhesive.

23. The method according to claim 20, wherein the coating layer comprises 0.05 to 0.10 parts by weight of conductive carbon black to 1.0 parts by weight of binder.

24. The method according to claim 20, wherein the mixing step comprises the steps of:

stirring the binder material at approximately 8000 rpm using ceramic beads;

adding a conductive material; and filtering the stirred binder with the dispersed conductive material to remove the ceramic beads.

25. A method for producing a back coating layer for a recording electrode assembly having an insulating sheet with a plurality of passages through which charged toner particles are ejected, a control electrode associated with each passage and the back coating layer is mounted to the insulating sheet on a side opposite that having the control electrodes, the method comprising the steps of:

adding an anti-electrification agent, wherein the anti-electrification agent includes a conductive material whose diameter is equal to or smaller than one-tenth the diameter of the charged toner particles, a lubricant, and an electric charge adjusting agent into a binder and stirring the binder;

applying the binder containing the anti-electrification agent, the lubricant, and the electric charge adjusting agent onto a support surface;

baking the binder applied onto the support surface; removing the baked binder from the support surface; and adhering the binder as the back coating layer onto the insulating sheet.

* * * * *